US006305476B1

(12) United States Patent
Knight

(10) Patent No.: US 6,305,476 B1
(45) Date of Patent: Oct. 23, 2001

(54) DEEP WELL FLEXIBLE HOSE AND METHOD OF USE

(76) Inventor: Roy Knight, P.O. Box 1516, Norman, OK (US) 73070

( * ) Notice: Subject to any disclaimer, the term of this patent is extended or adjusted under 35 U.S.C. 154(b) by 0 days.

(21) Appl. No.: 09/466,152

(22) Filed: Dec. 18, 1999

(51) Int. Cl.[7] ..... E21B 17/02

(52) U.S. Cl. ..... 166/385; 166/242.2

(58) Field of Search ..... 166/384, 385, 166/242.2, 381

(56) References Cited

U.S. PATENT DOCUMENTS 3,234,723 * 2/1966 Brown ..... 166/242.2

* cited by examiner

*Primary Examiner*—William Neuder
(74) *Attorney, Agent, or Firm*—R. William Graham

(57) ABSTRACT

A deep well flexible hose for use in extracting fluids and gases from deep wells includes a relatively flexible hose portion being of a length sufficient to extend to an operable position within the well, wherein the hose portion is of a predetermined temperature and pressure limit, corrosion resistance and weight load capacity and elasticity factor such that when the hose portion is so disposed in the well to the operable position, the hose portion's elasticity factor is exceeded due to the weight load normally exerted and means fixably connect to the hose portion for preventing the hose portion's elasticity factor from being exceeded at the operable position due to the weight load. A method is also provided.

6 Claims, 6 Drawing Sheets

Section A-A

DEEP WELL FLEXIBLE HOSE AND METHOD OF USE

BACKGROUND OF INVENTION

1. Field of Invention

The present invention relates to down hole tubing for wells. More particularly, but not by way of limitation, the invention relates to flexible hose well suited for deep well fluid and gas recovery applications.

2. Related Art

In most wells, rigid metal tubing is employed to carry fluids and gas out of the well. The metal tubing is very costly to transport and install, but needed in order to withstand the forces of gravity exerted on the tubing when installed at relatively large depths, i.e. thousands of feet below the surface. Although alternative conduit material exists which is relatively far less expensive, such conduit has not been employed for various structural limitations. For example, flexible synthetic hose is prone to bottle necking when installed at deep depths due to the weight load overcoming the elasticity factors of the hose.

Accordingly, there remains a need to improve conduit used in extracting fluids from wells. The present invention solves the described problems which exist with respect to such conduits and methods of installing the same.

SUMMARY OF THE INVENTION

It is an object to improve tubing in a well.

It is another object to reduce the cost of wells by enabling use of less expensive synthetic hose in relatively deep wells.

It is another object to improve the method in which hose is deployed in a well.

Accordingly, the present invention is directed to a deep well flexible hose and method of deploying the same. The hose includes well flexible hose for use in extracting fluids and gases from deep wells, comprising a relatively flexible hose portion being of a length sufficient to extend to an operable position within the well, wherein the hose portion is of a predetermined weight load capacity and elasticity factor such that when the hose portion is so disposed in the well to the operable position, the hose portion's elasticity factor is exceeded due to the weight load normally exerted and means fixably connect to the hose portion for preventing the hose portion's elasticity factor from being exceeded at the operable position due to the weight load.

A method is also provided. The method is directed to disposing flexible hose for use in extracting fluids and gases from a relatively deep well and includes the steps of:

providing a relatively flexible hose portion being of a length sufficient to extend to an operable position within the well, wherein said hose portion is of a predetermined weight load capacity and elasticity factor such that when said hose portion is so disposed in the well to said operable position said hose portion's elasticity factor is normally exceeded due to weight load existing thereon;

fixably connecting means to said hose portion for preventing said hose portion's elasticity factor from being exceeded at said operable position by said weight load; and deploying said flexible hose portion with said preventing means into the well.

Other objects will be apparent to the those skilled in the art from reading the following description and drawings attached hereto.

DETAIL DESCRIPTION OF THE INVENTION

Figure 1:
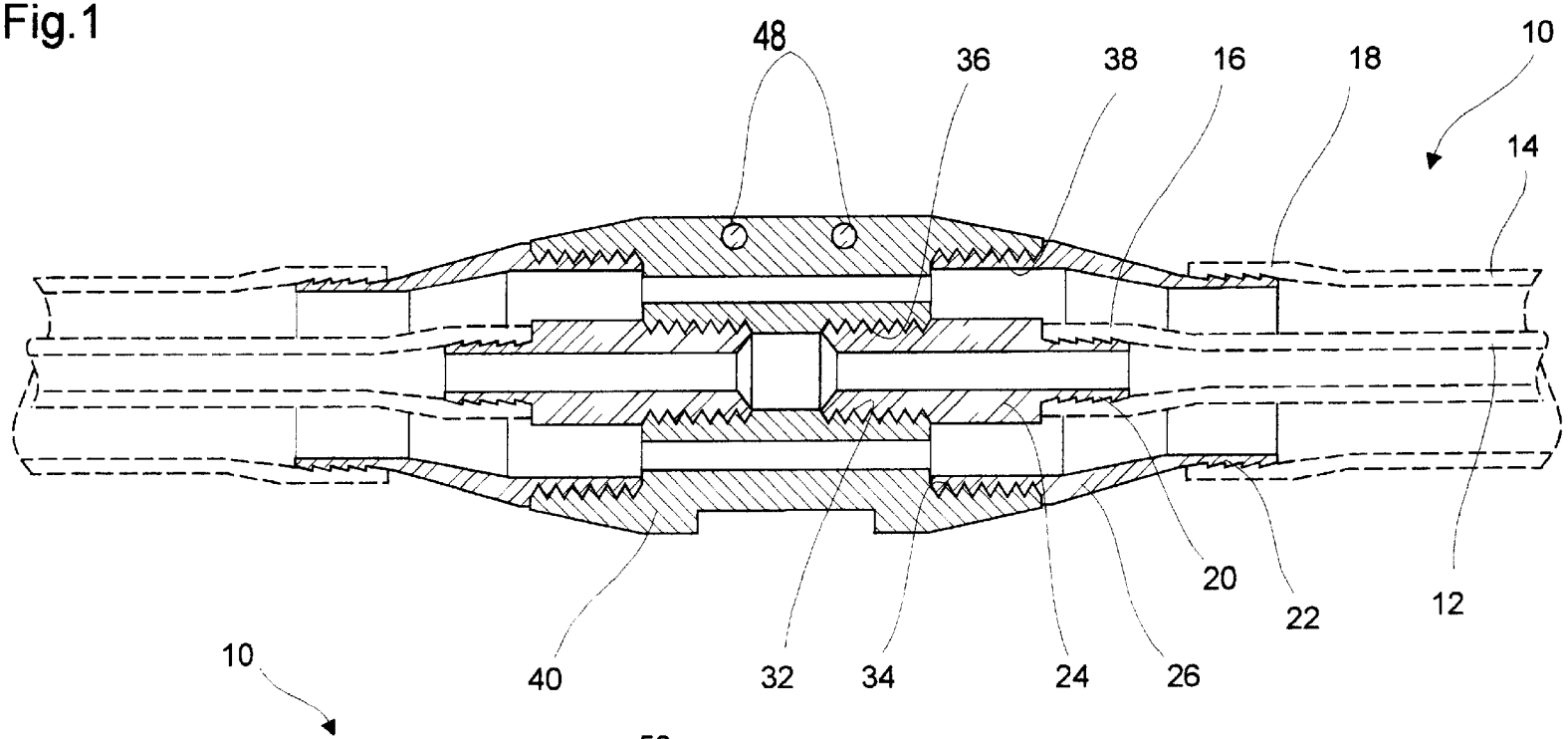
FIG. 1 depicts a portions of flexible hose of an embodiment of the present invention.
Figure 2:
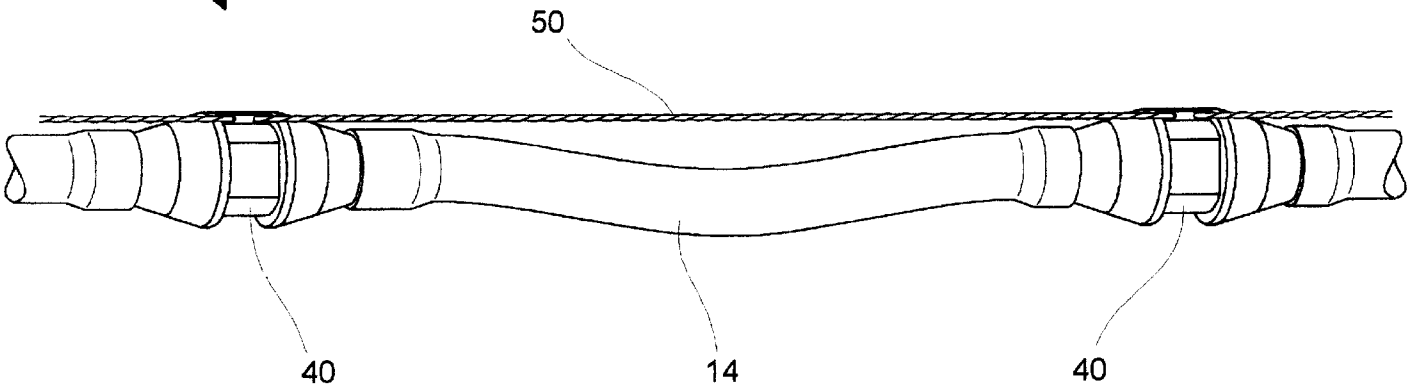
FIG. 2 depicts a greater portion of the hose in FIG. 1.
Figure 3:
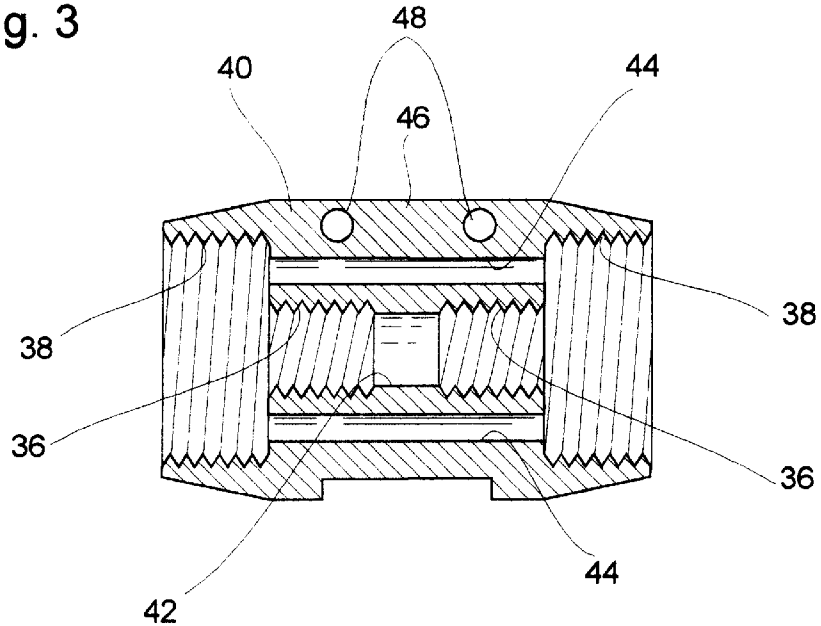
FIG. 3 shows a connector portion of the embodiment in FIG. 1.
Figure 4:
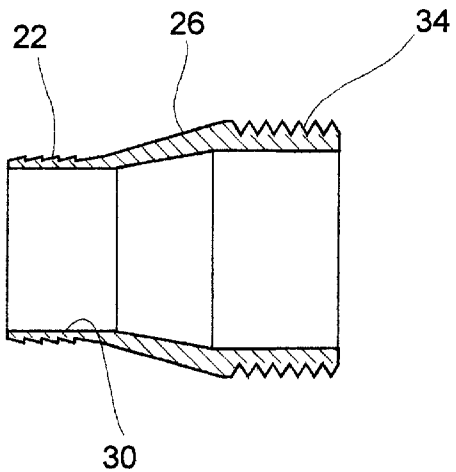
FIG. 4 shows another connector portion of the embodiment in FIG. 1.
Figure 5:
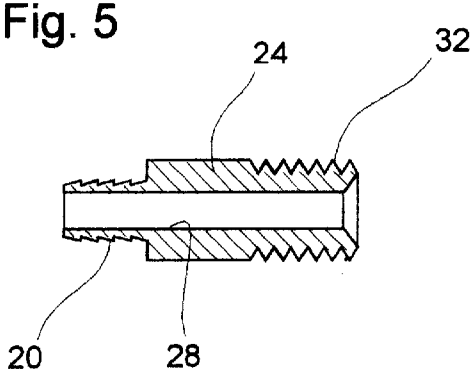
FIG. 5 shows still another connector portion of the embodiment in FIG. 1.

Referring now to the drawings, the flexible hose of the present invention is generally represented by the numerals 10, 100, 200, 200', 300 and 300'. For purposes herein, the flexible hose may include common components and material made of flexible synthetic polymer-based material as well as rigid inflexible components such as metal or rigid polymers or ceramic material with the proviso that the overall hose be characterized as relatively flexible or bendable, preferably to permit it to be rolled onto a spool or the like. The hose has predetermined pressure and temperature limits, corrosion resistance and weight load capacity. Additionally, a relatively flexible yet inelastic cable material, such as stainless steel, may be employed to carry out the invention.

Figure 6:
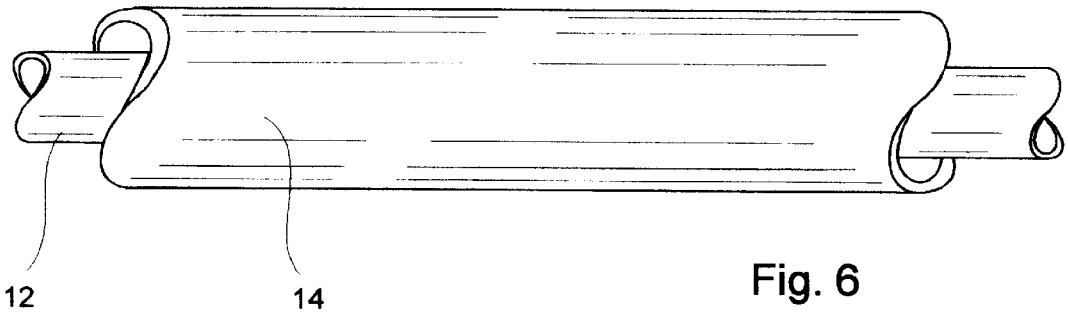
FIG. 6 depicts concentric hose portions used in FIG. 1.

Turning now to FIGS. 1–6, an embodiment of the flexible hose 10 is shown. The flexible hose 10 includes concentric hose portions 12 and 14 as seen in FIG. 1 and 6. The hose portions 12 and 14 have ends 16 and 18, respectively, which connect to ends 20 and 22 of male connectors 24 and 26, respectively, and formed with a ridged surface.

Each of the male connectors 24 and 26 have open surfaces 28 and 30 respectively, to allow communication therethrough. The connectors 24 and 26 and ends 32 and 34, respectively, which are threaded for connection to internal threaded surface 36 and 38, respectively, of a female coupling piece 40.

The female coupling piece 40 includes a plurality of channels 42 and 44, which interconnect threaded surface 36 and 38, respectively. The channels 44 are not completely concentrically annular extending about the channels 42 such that the female piece 40 is one piece. A peripheral portion 46 includes a plurality of openings 48 which extend therethrough.

A flexible non-elastic cable 50 is fed through the openings 48 in a binding manner to hold its position fixed relative to the female piece 40. In this way, the cable 50 carries the load of flexible hose 10. The benefit of this is that the flexible hose portions 12 and 14 are substantially precluded from bottle necking and inhibiting fluid/gas flow. The cost of material is decreased over that of a conventional tubing. Additionally, the flexible hose 10 permits easier installation and removal via the flexible hose 10 being able to be rolled up in a spool for transport as well as application in the well.

Figure 7:
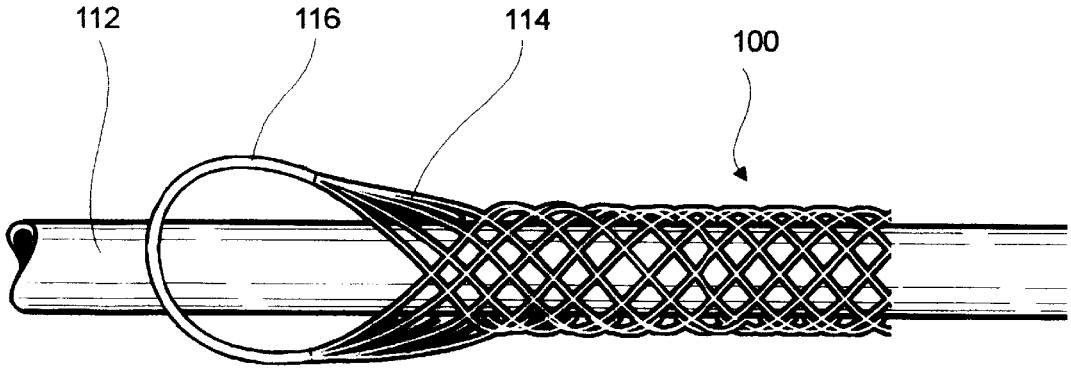
FIG. 7 depicts a portion of flexible hose of another embodiment of the present invention.
Figure 8:
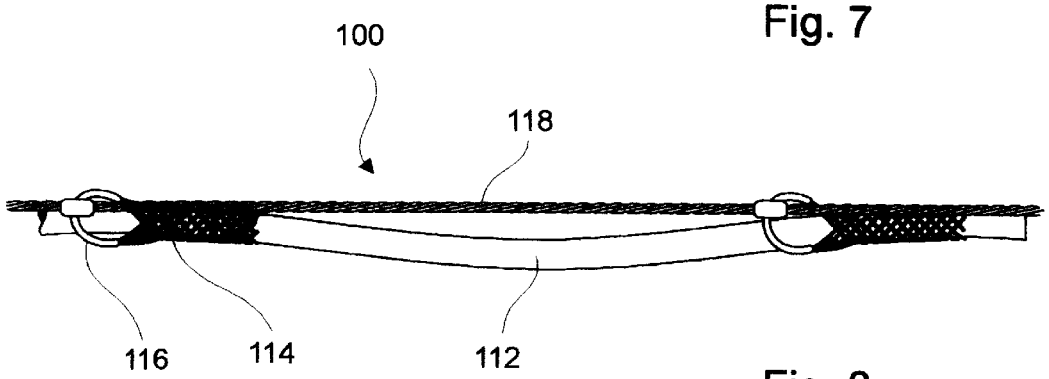
FIG. 8 depicts a greater portion of the hose in FIG. 7.

Turning to the embodiment in FIGS. 7 and 8, flexible hose 100 is depicted. Here, there is a flexible hose portion 112 which is supported by rigid strand grips 114 which weave into a cylindrical manner and permit insertion of the hose portion 112 therethrough. One end of the strand grips 114 forms a connecting loop 116. A plurality of the strand grips 114 are disposed at predetermined positions along the hose portion 112. A cable 118 interconnects the loop 116 via hooks 120 (or optionally welds) which maintain the strand grips 114 at relative spacing from one another in a manner to distribute the weight load proportionally over the length of the hose portion 112 to each of the strand groups 114. The strand grips 114 work to engage the hose portion 112 as the loop 116 is pulled via reducing the cylindrical diameter of the grips 114. FIGS. 7 and 8 show a single hose portion 112. It is contemplated that there can be several hose portions 112 disposed adjacent one another in the well wherein the same cable 118 is used to connect to the loops 116 of the other strand grips 114.

Figure 9:
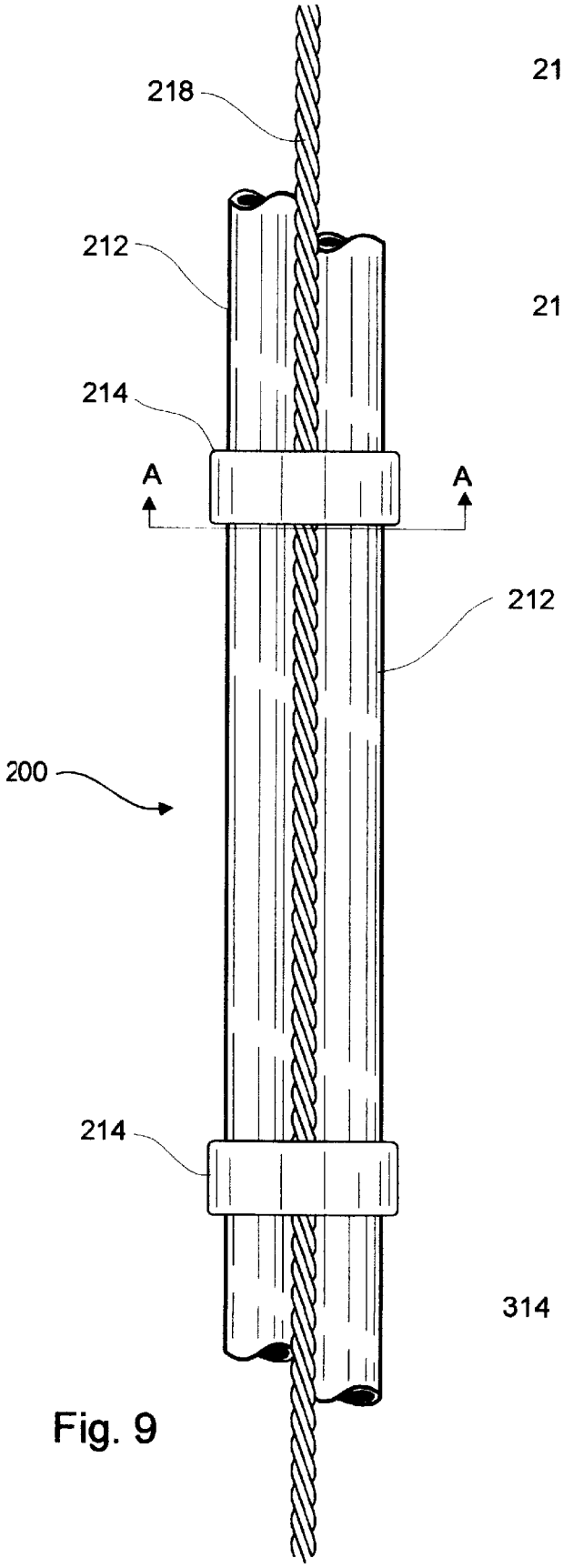
FIG. 9 depicts yet another embodiment of hose in the invention.
Figure 10:
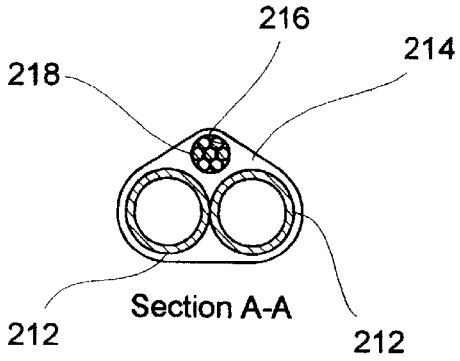
FIG. 10 depicts a cross-section through line A—A of FIG. 9.

FIGS. 9 and 10 display a similar concept in flexible hose 200. Here, the plurality hose pieces 212 are similarly supported at predetermined positions therealong by bands 214 which connect about the hose portions 212. The bands 214 include an opening 216 through which a cable 218 is passed as similarly discussed above. The cable 218 can be welded or otherwise fixed to the band 214. The bands 214 are shown single piece and can be multi-piece and are configured to apply sufficient holding pressure to support the length of hose portion 112 extending to the next band 214 disposed there beneath taking into account fluid flow therethrough in order to prevent bottle-necking. The bands 214 are of a relatively inelastic material.

Figure 11:
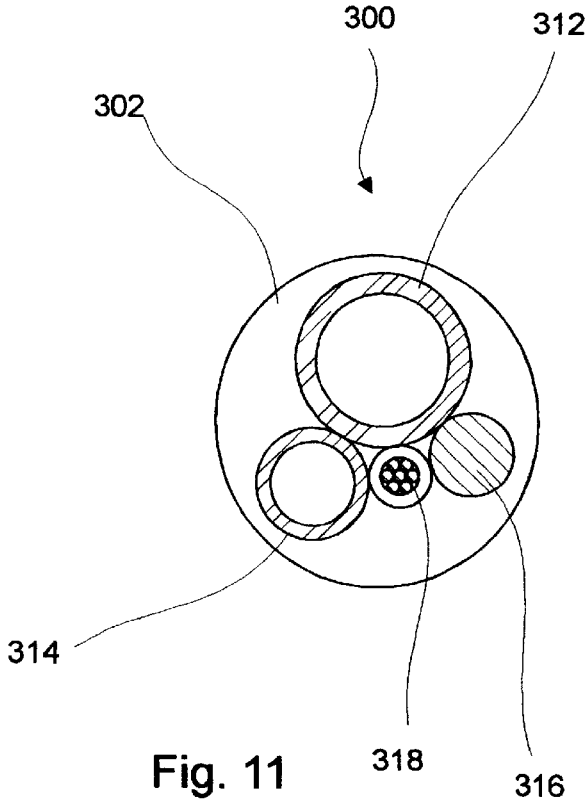
FIG. 11 depicts another cross-section of another embodiment of the invention.

FIG. 11 discloses still another embodiment 300. Here, the flexible hose 300 includes an outer sleeve 302, hose portions 312 and 314, wire 316 for enabling communications, and cable 318 for weight load support as described above. The sleeve 302 can be a band form as described above or an extruded or molded piece about the components. Similarly, the cable 318 is inelastic and interconnected to the other components via the sleeve 302.

Figure 14:
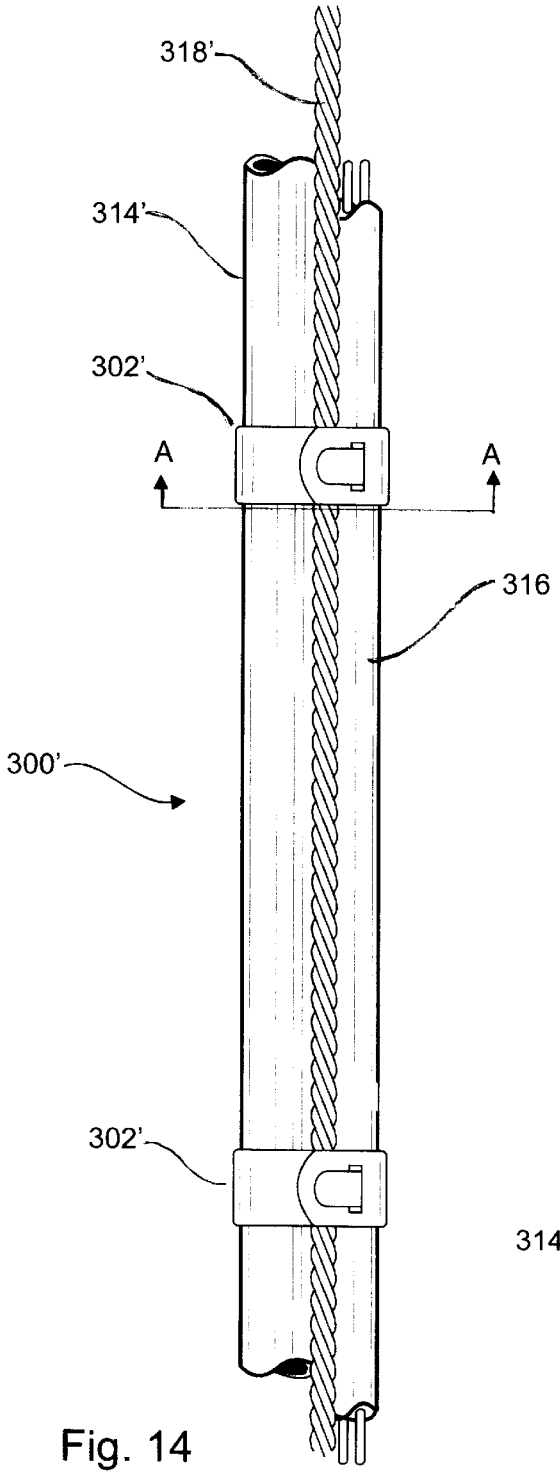
FIG. 14 depicts another cross-section of yet another embodiment of the invention.
Figure 12:
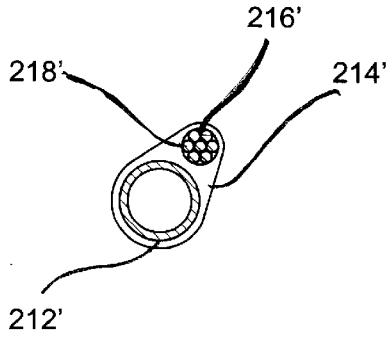
FIG. 12 depicts still another embodiment of hose in the invention.
Figure 13:
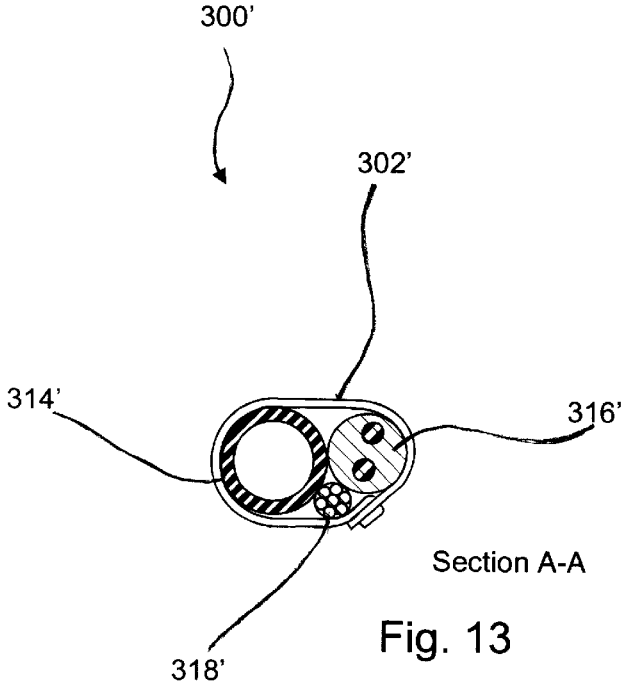
FIG. 13 depicts a cross-section through line A—A of FIG. 12.

FIGS. 12 and 13 disclose similar structures to that of FIGS. 9 and 10 with the difference being in that there is one hose portion 212' as opposed to two. FIG. 14 likewise shows one less hose and is otherwise similar to FIG. 11. These embodiments are useful for pump applications wherein only one hose is required. Also, the band 214' is shown as a clamp.

Figure 15:
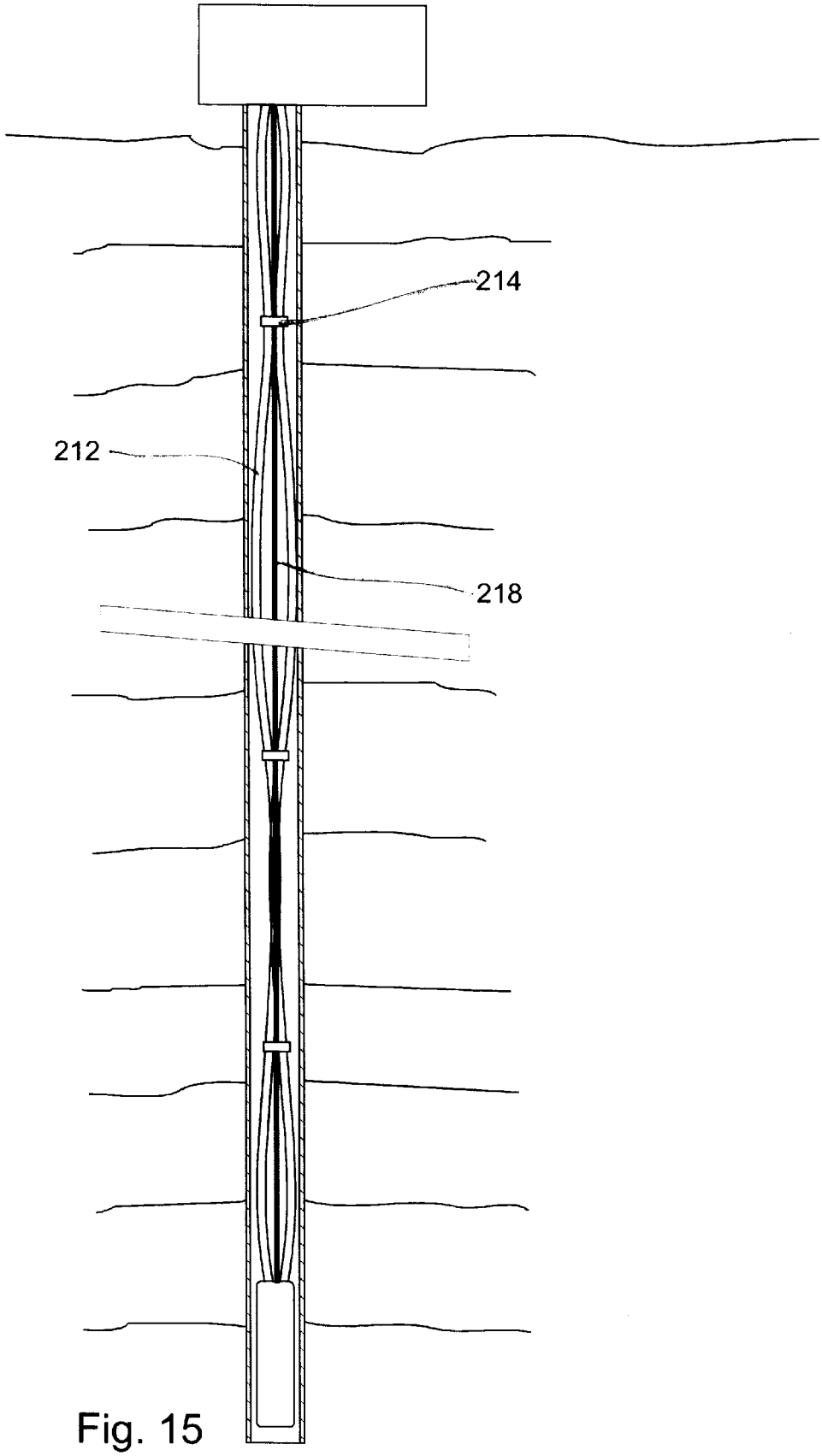
FIG. 15 depicts an embodiment disposed in a well.

FIG. 15 shows the embodiment of FIG. 9, for example, in a well application. FIG. 15 is depicted in a broken format to illustrate various depths of a well.

For purposes discussed herein, the hose portion is of a predetermined elasticity factor which when exceeded causes bottle-necking of the hose portion and inhibits fluid/gas flow. Due to deep well applications contemplated herein and the desire to use inexpensive flexible hose portions, such as rubber-like hose, the hose portions would normally exceed the elasticity factor at operable well depth due to weight load on the hose portion. The structures of the invention provide a means for preventing the elasticity factor from being overcome by transferring weight load to the cable via the connectors described.

While the embodiments are set forth above, they are not intended to be limiting. Modifications, derivations and improvements will be readily apparent to those skilled in the art and the same should be included in the scope of the claims appended hereto.

What is claimed is:

1. A flexible hose for use in extracting fluids and gases from a relatively deep well, comprising:

a relatively flexible hose portion being of a length sufficient to extend to an operable position within the well, wherein said hose portion is of a predetermined weight load capacity and elasticity factor such that when said hose portion is so disposed in the well to said operable position, said hose portion's elasticity factor is normally exceeded due to weight load existing thereon;

a sleeve fixably connected to said hose portion; and a relatively inelastic cable fixably connected to said sleeve such that said weight load is transferred to said cable via said sleeve and said cable aids in carrying said weight load such that said elasticity factor of said hose portion is not exceeded.

2. The deep well flexible hose of claim 1, which is further characterized to include a plurality of said sleeves disposed at predetermined positions along said hose portion, wherein said cable interconnects said sleeves.

3. The deep well flexible hose of claim 1, which is further characterized to include a plurality of adjacent hose portions and said preventing means includes a connector interconnecting said hose portions and a relatively inelastic cable connected to said connector such that said weight load is transferred to said cable via said connector and said cable aids in carrying said weight load such that said elasticity factor of said hose portions are not exceeded.

4. The deep well flexible hose of claim 1, wherein said hose portion is of a predetermined temperature and pressure limit and corrosion resistance.

5. A deep well flexible hose for use in extracting fluids and gases from a relatively deep well comprising:

a relatively flexible hose portion being of a length sufficient to extend to an operable position within a well, wherein said hose portion is of a predetermined weight load capacity and elasticity factor such that when said hose portion is so disposed in the well to said operable position, said hose portion's elasticity factors normally exceeded due to weight load existing thereon; and means fixably connected to said hose portion for preventing said hose portion's elasticity factor from being exceeded at said operable position by said load, said hose portion characterized as including a plurality of generally coaxially aligned hose portions, said coaxially aligned hose portions being concentrically positioned with an inner hose portion and outer hose portion, and said preventing means characterized as including a connector having concentric inner and outer communication means for permitting communication between said outer hose portion with said outer communication means and said inner hose portion with said inner communication means.

6. A method of disposing flexible hose for use in extracting fluids and gases from a relatively deep well, comprising:

providing a relatively flexible hose portion being of a length sufficient to extend to an operable position within the well, wherein said hose portion is of a predetermined weight load capacity and elasticity factor such that when said hose portion is so disposed in the well to said operable position, said hose portion's elasticity factor is normally exceeded due to weight load existing thereon;

providing a sleeve fixably connected to said hose portion; and providing a relatively inelastic cable fixably connected to said sleeve such that said weight load is transferred to said cable via said sleeve and said cable aids in carrying said weight load such that said elasticity factor of said hose portion is not exceeded.

* * * * *